US010082122B2

(12) United States Patent
Kirk

(10) Patent No.: US 10,082,122 B2
(45) Date of Patent: Sep. 25, 2018

(54) STARTER SYSTEM HAVING CONTROLLING RELAY SWITCH

(71) Applicant: REMY TECHNOLOGIES, LLC, Pendleton, IN (US)

(72) Inventor: Michael E. Kirk, Greenfield, IN (US)

(73) Assignee: REMY TECHNOLOGIES, LLC, Pendleton, IN (US)

( * ) Notice: Subject to any disclaimer, the term of this patent is extended or adjusted under 35 U.S.C. 154(b) by 0 days.

(21) Appl. No.: 15/611,402

(22) Filed: Jun. 1, 2017

(65) Prior Publication Data

US 2017/0268474 A1 Sep. 21, 2017

Related U.S. Application Data

(63) Continuation of application No. PCT/US2015/063826, filed on Dec. 3, 2015.

(60) Provisional application No. 62/087,707, filed on Dec. 4, 2014.

(51) Int. Cl.

| | |
|---|---|
| ***F02N 11/08*** | (2006.01) |
| ***F02N 11/00*** | (2006.01) |
| ***F02N 11/10*** | (2006.01) |
| ***F02N 15/06*** | (2006.01) |

(52) U.S. Cl.

CPC ..... *F02N 11/087* (2013.01); *F02N 11/0851* (2013.01); *F02N 11/0862* (2013.01); *F02N 11/106* (2013.01); *F02N 15/067* (2013.01); *F02N 2011/0874* (2013.01); *F02N 2200/043* (2013.01)

(58) Field of Classification Search

CPC ..... F02N 11/087; F02N 11/0851; F02N 11/0862; F02N 11/06; F02N 15/067; F02N 2011/0874; F02N 2200/043

USPC ..... 123/179.3, 179.1

See application file for complete search history.

(56) References Cited

U.S. PATENT DOCUMENTS

| | | | | |
|---|---|---|---|---|
| 4,917,411 | A * | 4/1990 | Cummins | F02N 11/087 290/38 R |
| 8,671,786 | B2 | 3/2014 | Notani | |
| 2002/0140291 | A1 | 10/2002 | Osada et al. | |

(Continued)

OTHER PUBLICATIONS

International Search Report and Written Opinion; PCT/US2015/063826; dated Mar. 11, 2016.

*Primary Examiner* — Mahmoud Gimie

(74) *Attorney, Agent, or Firm* — Bose McKinney & Evans LLP

(57) ABSTRACT

A starter system including a motor, a solenoid assembly having a solenoid switch, a pinion rotated by the motor and moveable into an engaging position in which an engine may be cranked and the solenoid switch is closed to energize the motor from an electric power source, and relay switch regulated by a controller and closed to apply electrical power to the solenoid assembly for actuating the solenoid switch. The controller repeatedly opens and closes relay switch during a starting operation if sensed motor energization voltage monitored by the controller falls below a predetermined threshold level within a predetermined time period after electrical power is applied to the solenoid assembly, whereby electrical power applications to the solenoid assembly are automatically repeated during a starting operation to correct "click-no-crank" events and prevent prolonged power application to the solenoid assembly. A related method is also disclosed.

20 Claims, 7 Drawing Sheets

(56) References Cited

U.S. PATENT DOCUMENTS

| | | | | |
|---|---|---|---|---|
| 2006/0106525 | A1 | 5/2006 | Hata | |
| 2010/0299053 | A1 | 11/2010 | Okumoto et al. | |
| 2011/0221210 | A1 | 9/2011 | Suzuki | |
| 2012/0162847 | A1* | 6/2012 | Suzuki | F02N 11/087 361/206 |
| 2014/0000541 | A1* | 1/2014 | Moriya | F02N 7/00 123/179.3 |

* cited by examiner

| | | Functional Circuit of Controller 108 | | | | | | |
|---|---|---|---|---|---|---|---|---|
| Feature | Prevented Failure Mode | Gate Drive Circuit 194 | Power Driver Circuit 196 | Voltage Divider Circuit 198 | Level Circuit 200 | 5V Regulating Circuit 202 | Voltage Divider Circuit 204 | Voltage Divider Circuit 206 |
| Rapid re-engagement lockout | Damaged pinion and ring gear teeth | X | | X | X | X | X | |
| Running engine lockout | Engagement with running engine/ Damaged pinion and ring gear teeth | X | X | | X | X | X | |
| Low voltage lockout | Overcrank/ Solenoid Chatter | X | X | X | X | X | X | |
| Time-limited crank | Overcrank | X | X | X | X | X | X | |
| Engagement monitor/Auto-retry | Click-no-crank (driver annoyance)/ Solenoid prolonged power | X | X | X | X | X | X | X |
| Auto-disengage at engine start | Extended overrun | X | X | X | X | X | X | |

FIG. 6

STARTER SYSTEM HAVING CONTROLLING RELAY SWITCH

RELATED APPLICATIONS

This application is a continuation of PCT/US2015/063826, filed Dec. 3, 2015, which claims priority to U.S. Provisional Patent Application Ser. No. 62/087,707, filed Dec. 4, 2014, both of which are hereby incorporated herein by reference in their entireties.

BACKGROUND

The present disclosure relates to starter systems and magnetic relay switches used therein, and particularly to controllers for such switches and thus for such systems.

An exemplary starter system of a type used extensively for many years in automotive applications is depicted in FIG. 1. Starter systems for some light-duty passenger car applications have evolved over recent years to the extent that, in some cases, such conventional starter systems, which are solely operator-activated, have been replaced by starter systems having stop-start and/or change-of-mind capabilities that operatively engage a temporarily stopped engine for restarting automatically through use of a controller on the basis of vehicle and engine conditions and sensed operator inputs, without the operator separately initiating starter operation. Nevertheless, conventional starter systems are still commonly utilized today for some light duty applications and many heavy duty applications such as heavy trucks, buses and tractors. It is to be understood, therefore, that herein "conventional" means a starter system in which starter system operation is initiated by the operator, rather than merely to a prior starter system.

Prior conventional starter system 20 shown in FIG. 1 includes starter assembly 22, an operator-actuated starter switch 24, battery 26, and engine ring gear 28 affixed to a flywheel and engine crankshaft 30. Crankshaft 30 and ring gear 28 are rotatable about crankshaft axis of rotation 32. Battery 26 may be a singular battery as shown, or battery 26 may be a plurality of batteries connected in series. Light duty applications typically employ a single 12V battery 26. A pair of series-connected 12V batteries forms a 24V battery 26 commonly used in heavy duty applications including large trucks, buses and tractors. The components of starter system 20 are appropriately sized for the voltage output of its battery 26. Starter systems 20 are typically negatively grounded, as shown, wherein negative terminal 84 of battery 26 is at all times connected to ground 90.

Starter assembly 22 has motor housing/frame structure 34 typically made of electrically conductive material such as steel and houses starter motor 36. Starter motor 36 includes stator windings or coil 38 which, when energized, driveably rotates the rotor (not shown) and output shaft 40 of motor 36. Motor 36 may be connected to ground 90 through motor housing/frame structure 34, which is affixed to and in electrical contact with the grounded engine. Alternatively, motor 36 may be separately grounded. Output shaft 40 is coupled to collar 42 and, in some embodiments, an overrunning clutch 44 as shown. Collar 42 and overrunning clutch 44, if present, are operably coupled to pinion 46 which is rotatable about axis of rotation 48 common to pinion 46 and motor output shaft 40. The provision of overrunning clutch 44 permits pinion 46 to be rotated about axis 48 at an angular speed exceeding that of motor output shaft 40, thereby preventing starter motor 36 from being driven by pinion 46 if the pinion is still engaged with ring gear 28 once the engine starts.

Starter assembly 22 also includes solenoid assembly 50. Solenoid assembly 50 includes axially moveable solenoid plunger 52 and compression spring 53 which exerts a biasing force on plunger 52 that urges it leftwardly as viewed in FIG. 1 into the plunger extended position. Solenoid plunger 52 has end 54 linked to first end 56 of shift lever 58. The opposite second end 60 of shift lever 58 is linked to collar 42. Shift lever 58 is pivotally attached to starter assembly frame structure 34 at a location between shift lever first and second ends 56, 60. As discussed further below, energization of solenoid assembly 50 causes rightward movement of solenoid plunger 52 towards the plunger retracted position that effects pivoting motion of shift lever 58 about its pivot point, whereby pinion 46 is moved leftwardly from its disengaged position towards its engaged position. Pinion 46 is in meshed engagement with ring gear 28, and engine cranking with starter assembly 22 can occur, only in the pinion's engaged position.

Starter system 20 also includes integral magnetic starter relay switch assembly (or IMS) 62 that includes an electromagnetically-actuated relay switch and may be an attached component of starter assembly 22. As shown, IMS 62 has metallic switch housing 64 affixed to and grounded through starter assembly motor housing 34. IMS 62 has switch cover 66 attached to switch housing 64 with a plurality of screws 67. In the embodiment shown, switch cover 66 is provided with relay switch activation terminal 68. IMS 62 has relay switch grounding terminal 70 affixed in electrical communication with the interior of metallic switch housing 64, which is grounded through its attachment to motor housing 34. Those having ordinary skill in the relevant art will recognize, however, that grounding terminal 70 may be insulated from switch housing 64 and separately grounded.

Disposed within switch housing 64 is electromagnetic relay switch activation coil 72 disposed about axially moveable ferrous plunger 74. Activation coil 72 extends between activation terminal 68 and grounding terminal 70. With terminal 70 electrically connected to ground 90, energization of activation terminal 68 induces current flow through activation coil 72, which effects axial movement of plunger 74 against the biasing force of compression spring 75. Electrically conductive contact plate 76 is carried by and electrically insulated from plunger 74. First switch contact 78 is electrically connected to first switch terminal 79 mounted in switch cover 66. Second switch contact 80 is electrically connected to second switch terminal 81 mounted in switch cover 66. First switch contact 78, second switch contact 80 and contact plate 76 define relay switch 83 disposed within IMS 62.

Due to the biasing influence of compression spring 75, contact plate 76 is normally out of contact with first switch contact 78 and/or second switch contact 80, whereby relay switch 83 is biased into an open condition in which first and second switch terminals 79, 81 are out of electrical communication with each other. Current flow through relay switch activation coil 72 electromagnetically moves plunger 74 against the biasing force of spring 75 and brings contact plate 76 into electrical contact with first switch contact 78 and second switch contact 80, whereby relay switch 83 is electromagnetically closed. When closed, relay switch 62 places first and second switch terminals 79, 81 in electrical communication with each other. Positive terminal 82 of battery 26 is in continuous electrical communication with first switch terminal 79, whereby battery voltage is at all times applied to first switch contact 78. Thus, with relay switch 83 closed, battery voltage is provided to second switch terminal 81 of IMS 62.

Operator-actuable starter switch 24 is biased open and its closure by an operator applies voltage to activation coil 72 and commences a starting operation. Starter switch 24 can be of a typical "push-to-make" momentary type such as a key switch commonly used with an ignition key for starting a vehicle engine. Starter switch 24 need not employ a separable key, and may be actuable by an operator through various suitable means known to one having ordinary skill in the art. Starter switch 24 has first and second starter switch contacts 86, 88. First starter switch contact 86 is electrically connected to positive terminal 82 of battery 26. Second starter switch contact 88 is electrically connected to activation terminal 68 of starter relay switch 62. Starter switch 24 is selectively actuated through manipulation by an operator, when moved from its biased open condition and temporarily held by the operator in a closed condition wherein first starter switch contact 86 is in electrical communication with second starter switch contact 88. Thus, with starter switch 24 held closed, battery voltage is applied to relay switch activation terminal 68 and, with terminal 70 electrically connected to ground 90, current is conducted through relay switch activation coil 72, consequently electromagnetically closing relay switch 83 and providing battery voltage to second switch terminal 81 of IMS 62.

Solenoid assembly 50 includes pull-in coil 92 and hold-in coil 94 both disposed about the longitudinal axis of ferrous solenoid plunger 52 and connected to IMS second switch terminal 81. Pull-in coil 92 is connected to motor coil 38, which is connected to ground 90; hold-in coil 94 is directly connected to ground 90. Current flow received by starter motor coil 38 from pull-in coil 92 is insufficient to operably drive motor 36. Indeed, in conventional starter system such as starter system 20, it is generally undesirable to rotate the pinion 46 prior to its engagement with engine ring gear 28. Solenoid assembly 50 includes first and second solenoid switch contacts 96, 98 which are selectively electrically connected through solenoid contact plate 100 insulated from and carried by solenoid plunger 52. First and second solenoid switch contacts 96, 98 and solenoid contact plate 100 define solenoid switch 102, which is biased open under the influence of compression spring 53 acting on solenoid plunger 52.

First solenoid switch contact 96 is electrically connected to battery positive terminal 82, whereby it is continuously provided with battery voltage. As shown, first switch terminal 79 is connected to first solenoid switch contact 96, through which battery voltage is provided to first switch terminal 79. Second solenoid switch contact 98 is located between pull-in coil 92 and motor coil 38. The closing of starter relay switch 62 and consequent application of battery voltage to second switch terminal 81 directs current through pull-in coil 92 and hold-in coil 94, which urges solenoid plunger 52 rightwardly, as viewed in FIG. 1, against the biasing force of compression spring 53, to establish and maintain electrical communication between first and second solenoid switch contacts 96, 98 through contact plate 100 carried by solenoid plunger 52, thereby placing solenoid switch 102 in its closed state. The rightward movement of solenoid plunger 52 also urges pinion 46 leftwardly toward engagement with ring gear 28.

With solenoid switch 102 closed, motor-energizing battery voltage is applied to starter motor coil 38, thereby starting operable rotation of motor 36 and pinion 46. With solenoid switch 102 closed, battery voltage is also applied to both ends of pull-in coil 92, thereby halting current flow therethrough and causing a reduction in the total electromagnetic force on solenoid plunger 52 that opposes compression spring 53. The rightward position of solenoid plunger 52 is then maintained by the electromagnetic force generated by current flow through hold-in coil 94, to which battery voltage remains applied via second switch terminal 81. The interruption of current flow through solenoid hold-in coil 94, as would result from the opening of starter switch 24 and, consequently, relay switch 83, allows compression spring 53 to move solenoid plunger 52 and contact plate 100 leftwardly, which urges pinion 46 out of engagement with ring gear 28 through shift lever 58, and interrupts electrical communication between first and second solenoid switch contacts 96, 98, thereby de-energizing motor 36.

It is well-known by those having ordinary skill in the art that prior conventional starter systems have been susceptible to one or more of several well-known problems or failure modes:

A first such problem or failure mode includes incidences of "click-no-crank" occurrences wherein the axial face of the starter assembly pinion is driven into abutment with the interfacing axial surface of the engine ring gear 28, rather than their respective teeth becoming enmeshed. Such incidences involve energization of the starter solenoid assembly 50 during operator activation of switch 24, which results in the pinion-ring gear abutment (typically resulting in an audible "click") blocking movement of solenoid switch contact plate 100 into electrical contact with first solenoid switch contact 96 and second solenoid switch contact 98, thereby preventing solenoid switch 102 from closing. Prolonged application of electrical power to solenoid assembly 50 during an abutting condition between the faces of pinion 46 and ring gear 28 can prevent meshed engagement therebetween. The necessary meshing between these gears cannot be accomplished if the abutting faces remain in contact under force.

In some prior conventional starter system embodiments, such as system 20 shown in FIG. 1, solenoid switch 102 being prevented from closing causes electrical power to be applied to solenoid assembly 50 through relay switch 83 while starter switch 24 is closed. An operator holding starter switch 24 closed while solenoid switch 102 remains open causes current to flow from battery 26 to ground 90 through relay switch 83 and solenoid coils 92 and/or 94, and can quickly drain battery 26. Moreover, the energization of motor 36 provided via solenoid pull-in coil 92 while solenoid switch 102 is prevented from closing is often insufficient to rotate pinion 46 into a position wherein it can be received into its engaged position, wherein it is enmeshed with ring gear 28 and closure of solenoid switch 102 occurs. Thus, in the case of some prior starter systems, while the audible noise and need for the operator to open and reclose starter switch 24 to commence a new starting operation can be annoying, "click-no-crank" occurrences can lead to further starting attempts being unsuccessful due to a consequent lack of available cranking power.

One prior approach to solving the problems of "click-no-crank" occurrences or the consequences of solenoid prolonged power application that is well-known to those having ordinary skill in the art has involved configuring a starter assembly with a "soft start" starter motor engagement system whereby the pinion and the ring gear are enmeshed before full electrical power is applied to the starter motor. Another such approach has been configuring the starter assembly include a jump spring acting between the solenoid plunger and the pinion, which allows the plunger to continue its axial movement and accomplish solenoid switch closure and motor energization despite abutting engagement occurring between axially interfacing pinion and ring gear faces, the jump spring urging the pinion axially into meshed engagement with the ring gear as the pinion begins to rotate. Nevertheless, for reasons of cost, reliability and/or complexity, or for other reasons, the above-mentioned prior approaches have not been incorporated into some starter systems, particularly those for heavy duty applications.

A second such problem sometimes encountered with prior conventional starter systems such as starter system 20, is that starter motor energization may occur prior to pinion 46 being positioned to mesh with the ring gear 28, which can result in damage to the pinion and ring gear teeth. Even if starter motor 36 is no longer energized, rotating inertia of its rotor, output shaft 40 and pinion 46 may cause it to continue rotating during rapid re-engagement of pinion 46 with ring gear 28. Such occurrence may happen when the operator does not fully depress the vehicle clutch pedal during engine starting, which typically results in a lockout of starter system operation. Those having ordinary skill in the art often refer to these problematic re-engagements as being caused by an operator's "lazy clutch foot." Pinion 46, when unloaded typically rotatable at between 3500 and 6500 RPM, may thus intermittently contact ring gear 28 due to inadvertent repeated engagement of starter assembly 22, which can result in damage to the pinion and ring gear teeth.

A third such problem sometimes encountered with prior conventional starter systems such as starter system 20 relates to engagement of the starter assembly 22 with an already running engine. Engagement of pinion 46 with the already spinning ring gear 28 can also result in damage to the pinion and ring gear teeth.

A fourth such problem sometimes encountered with prior conventional starter systems such as starter system 20 relates to solenoid chatter resulting from low battery voltage. In such cases the low battery voltage level is sufficient to energize the solenoid assembly 50 and move the plunger 52 and the pinion 46 axially (and in some embodiments to close solenoid switch 102), but it is insufficient to allow starter motor 36 to rotate the pinion, much less crank the engine. In such cases solenoid assembly 50 may not cause pinion 46 to fully enter into meshed engagement with the ring gear 28. Solenoid chatter can result from repeated impact between axially interfacing surfaces of the pinion 46 and engine flywheel 28, or from oscillating, axially opposite movements of the solenoid plunger 52 which are induced by the pull-in coil 92 and the biasing compression spring 53, near the position into which it is biased by the compression spring 53.

A fifth such problem sometimes encountered with prior conventional starter systems such as starter system 20 relates to overcranking conditions in which starter assembly 22 is allowed to crank continually, which may occur if the engine does not start as desired. Overcranking can result in higher than desired temperatures in the starter assembly 22, and thermal degradation of its components over time. Moreover, overcranking can lead to battery 26 being drained to such an extent that insufficient cranking power is delivered to the motor 36.

A sixth such problem sometimes encountered with prior conventional starter systems such as starter system 20 which lack an overrunning clutch 44, is the overrunning of starter motor 36 by the started engine. This can occur, for example, if pinion 46 fails to disengage ring gear 28 upon the engine's starting. Overrunning of starter motor 36 can result in undesirably high starter temperatures and thermal degradation, and in some starter system embodiments can cause starter motor 36 to undesirably operate as a generator. As noted above, overrunning clutch 44, if present, allows pinion 46 to be driven by ring gear 28 beyond the rotational speed of motor output shaft 40. Nevertheless, extended overrunning of pinion 46 decoupled from motor output shaft 40 can result in overrunning clutch 44 experiencing undesirably high temperatures and thermal degradation.

It is desirable to address these well-known problems occurring in conventional starter systems. Moreover, it is particularly desirable to provide a conventional starter system that avoids these problems or failure modes and operates independently of other vehicle systems, and controls starter operation without being receivable of a signal indicative of a measured engine speed, whether from outside the starter system, as from another system or an ECU, or from a dedicated engine speed sensor.

Notably, certain starter system applications, particularly heavy duty vehicle or engine applications, may be of a type which either do not already utilize a measured engine speed signal, or which require significant cost and additional complexity to make a currently existing engine speed signal available for use in regulating a starter system. A stand-alone, controllable starter system that avoids the above-mentioned problems and is operable independently of other vehicle systems and without requiring a signal indicative of a measured engine speed, would be particularly desirable for use in certain applications.

SUMMARY

The present disclosure provides a starter system having a relay switch regulated by a controller. In some embodiments, the regulated relay switch and its connected controller are integrated into an IMS to provide an "intelligent" IMS ("iIMS"). The controller may be provided with various functional circuits and a communicating microcontroller unit. The controller communicates with other portions of the iIMS and the starter system to control whether the relay switch is to be open or closed, and consequently whether electrical power is to be applied to the solenoid assembly during a starting operation, i.e., when the starter switch is held closed by the operator.

Moreover, the present disclosure provides a starter system operable independently of other control systems of a vehicle and without the controller being receivable of a signal indicative of engine speed, whereby the system defines a stand-alone system adapted for being separately installed in the vehicle.

A starter system regulated by controlling a relay switch according to the present disclosure may be selectively adapted to provide any or all of several operational features or functions for preventing or self-correcting occurrence of the above-mentioned failure modes:

Starter engagement monitoring and auto-retry, which corrects occurrences of click-no-crank events, and prevents prolonging power application to the solenoid assembly;

Rapid starter re-engagement lockout, which prevents damage to the pinion and ring gear teeth;

Running engine starter lockout, which prevents starter engagement with the running engine, and damage to the pinion and ring gear teeth;

Low voltage starter lockout, which prevents overcranking and solenoid chatter;

Time-limited starter cranking, which prevents overcranking; and

Automatic starter disengagement at engine start, which prevents extended overrun.

This disclosure comprises, in one form thereof, a system for starting an engine. The system has a relay switch that is closed during a starting operation, and a starter assembly including a solenoid switch adapted for connection to an electrical power source. The starter assembly also includes a motor connected to the solenoid switch and energized by the electrical power source when the solenoid switch is closed, and a pinion rotatably coupled to the motor. The pinion is moveable between an engaged position in which the engine may be cranked by the starter assembly and a disengaged position. The system also includes a controller connected to the relay switch.

During a starting operation, if sensed motor energization voltage monitored by the controller falls below a predetermined threshold level within a predetermined time period after the application of electrical power to the solenoid assembly, the controller opens and recloses the relay switch to switch electrical power to the solenoid assembly off and on. Consequently, a "click-no-crank" event can be corrected during the starting operation.

In some embodiments of the system, the controller is configured to switch electrical power to the solenoid assembly off and on by opening the relay switch, and waiting a predetermined time delay period before reclosing the relay switch. Optionally, the pinion does not enter a fully disengaged position prior to the controller reclosing the relay switch.

In some embodiments of the system, the predetermined time delay period is a value less than 600 ms.

In some embodiments of the system, the predetermined time delay period is a value less than 100 ms.

In some embodiments of the system, the system is defined as a 24V starter system and the predetermined threshold level is a value less than 11.0V.

In some embodiments of the system, the system is defined as a 24V starter system and the predetermined threshold level is a value less than 6.0V.

In some embodiments of the system, the system is defined as a 12V starter system and the predetermined threshold level is a value less than 6.0V.

In some embodiments of the system, the system is defined as a 12V starter system and the predetermined threshold level is a value less than 4.0V.

In some embodiments of the system, the predetermined time period is a value no more than 600 ms.

In some embodiments of the system, the predetermined time period is a value no more than 150 ms.

In some embodiments of the system, the controller limits the number of times the relay switch is opened and reclosed to switch electrical power to the solenoid assembly off and on during the starting operation.

In some embodiments of the system, the relay switch is biased open and electromagnetically closed, and the system further includes an activation coil to which voltage is applied during each starting operation. During a starting operation the controller selectively permits grounding of current through the activation coil to close the relay switch and prevents grounding of current through the activation coil to open the relay switch. The controller regulates the relay switch through the selective grounding of the activation coil.

In some embodiments of the system, the pinion is biased into its disengaged position in the absence of electrical power application to the solenoid assembly. The controller monitors sensed voltage applied to the activation coil and during a starting operation opens the relay switch when the sensed voltage applied to the activation coil rises to a threshold voltage level. Consequently, the pinion is automatically moved to the disengaged position upon the engine starting.

Some embodiments of the system further include a momentary starter switch biased open and closed through operator actuation to commence each starting operation. Voltage is applied to the activation coil only when the momentary starter switch is closed.

In some embodiments of the system the controller includes a plurality of functional circuits selectively interconnected in accordance with a starter system paradigm for regulating the relay switch.

In some embodiments of the system the functional circuits include a gate drive circuit, a power driver circuit, a level circuit, a regulating circuit and a plurality of voltage divider circuits.

Some embodiments of the system are for installation in a vehicle including the engine and a battery comprising the electrical power source. The system is operable independently of other vehicle control systems and without the controller monitoring a signal indicative of an engine speed, whereby the system defines a stand-alone starter system adapted for installation in a vehicle separately from other vehicle control systems.

In some embodiments of the system the controller monitors time elapsed after commencement of a starting operation and delays permitting reclosing the relay switch, whereby rapid re-engagement of the pinion and the engine is prevented.

In some embodiments of the system the electrical power source is a battery, and the controller monitors sensed battery voltage and prevents the relay switch closing if the sensed battery voltage is greater than a predetermined threshold voltage. Consequently, starter assembly operation is prevented while the engine is running.

In some embodiments of the system the electrical power source is a battery, and the controller monitors sensed battery voltage with the solenoid switch open and prevents the relay switch closing if the sensed battery voltage is no greater than a predetermined threshold voltage. Consequently, starter assembly operation is prevented if the sensed battery voltage is below the threshold voltage.

In some embodiments of the system the electrical power source is a battery, and the controller monitors sensed battery voltage with the solenoid switch closed and opens the relay switch if the sensed battery voltage drops below a threshold voltage while the motor is energized. Consequently, the present starting attempt is aborted if battery voltage becomes lower than the threshold voltage during engine cranking.

In some embodiments of the system the controller monitors time elapsed after commencement of a starting operation, limits the maximum duration of an application of electrical power to the solenoid assembly to a first predetermined time period, and delays occurrences of consecutive starting operations by a second predetermined time period. Consequently, continuous cranking time and the frequency of starting operations are limited.

In some embodiments of the system the starter assembly, the relay switch and the controller define a unitary assemblage.

Another embodiment takes the form of a unitary starter assembly. The starter assembly has a relay switch that is closed during a starting operation, and a solenoid switch adapted for connection to an electrical power source. The starter assembly also includes a motor connected to the solenoid switch and energized by the electrical power source when the solenoid switch is closed, and a pinion rotatably coupled to the motor. The pinion is moveable between an engaged position in which the engine may be cranked by the starter assembly and a disengaged position. The system also includes a controller connected to the relay switch.

During a starting operation, if sensed motor energization voltage monitored by the controller falls below a predetermined threshold level within a predetermined time period after the application of electrical power to the solenoid assembly, the controller opens and recloses the relay switch to switch electrical power to the solenoid assembly off and on. Consequently, a "click-no-crank" event can be corrected during the starting operation.

In some embodiments of the starter assembly the controller limits the number of times the relay switch is opened and reclosed to switch electrical power to the solenoid assembly off and on during the starting operation.

In some embodiments of the starter assembly the controller includes a plurality of functional circuits selectively interconnected in accordance with a starter system paradigm for regulating the relay switch. The functional circuits include a gate drive circuit, a power driver circuit, a level circuit, a regulating circuit and a plurality of voltage divider circuits.

In some embodiments of the starter assembly the relay switch is biased open and electromagnetically closed, and the starter assembly further includes an activation coil to which voltage is applied during each starting operation. During a starting operation the controller selectively permits grounding of current through the activation coil to close the relay switch and prevents grounding of current through the activation coil to open the relay switch. The controller regulates the relay switch through the selective grounding of the activation coil.

Some embodiments of the starter assembly are adapted for attachment to the engine of a vehicle having a battery that comprises the electrical power source. The starter assembly is adapted for connection to a momentary starter switch biased open and closed through operator actuation to commence each starting operation. Voltage is applied to the activation coil only when the momentary starter switch is closed. The starter assembly is operable independently of other vehicle control systems and without the controller receiving a signal indicative of an engine speed, whereby the starter assembly and the connected operator-actuable starter switch define a stand-alone starter system adapted for installation in a vehicle separately from other vehicle control systems.

In some embodiments of the starter assembly the controller is configured to switch electrical power to the solenoid assembly off and on by opening the relay switch, and waiting a predetermined time delay period before reclosing the relay switch. Optionally, the pinion does not enter a fully disengaged position prior to the controller reclosing the relay switch.

In some embodiments of the starter assembly the system is defined as a 24V starter system and wherein the predetermined threshold level is a value less than 11.0V.

In some embodiments of the starter assembly the system is defined as a 12V starter system and wherein the predetermined threshold level is a value less than 6.0V.

Another embodiment takes the form of a method for regulating a starter system. The method includes the following steps: providing electrical power to a relay switch; commencing a starting operation with an operator-actuable starter switch; using a controller during the starting operation to close the relay switch for applying electrical power to a solenoid assembly; using the powered solenoid assembly to urge a pinion rotatable by an energized motor toward an engaged position in which the engine may be cranked using the starter system, and to connect the motor to an energizing electrical power source through a solenoid switch closed when the pinion is in the engaged position; and using the controller to monitor sensed motor energization voltage and for opening and reclosing the relay switch during the starting operation to switch electrical power to the solenoid assembly off and on if sensed motor energization voltage falls below a predetermined threshold level within a predetermined time period after the application of electrical power to the solenoid assembly. Consequently, a "click-no-crank" event can be corrected during the starting operation.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein:

FIG. 6 is a table associating individual functional circuits shown in FIG. 5 with operational features of a starter system according to the present disclosure;

Figure 1:
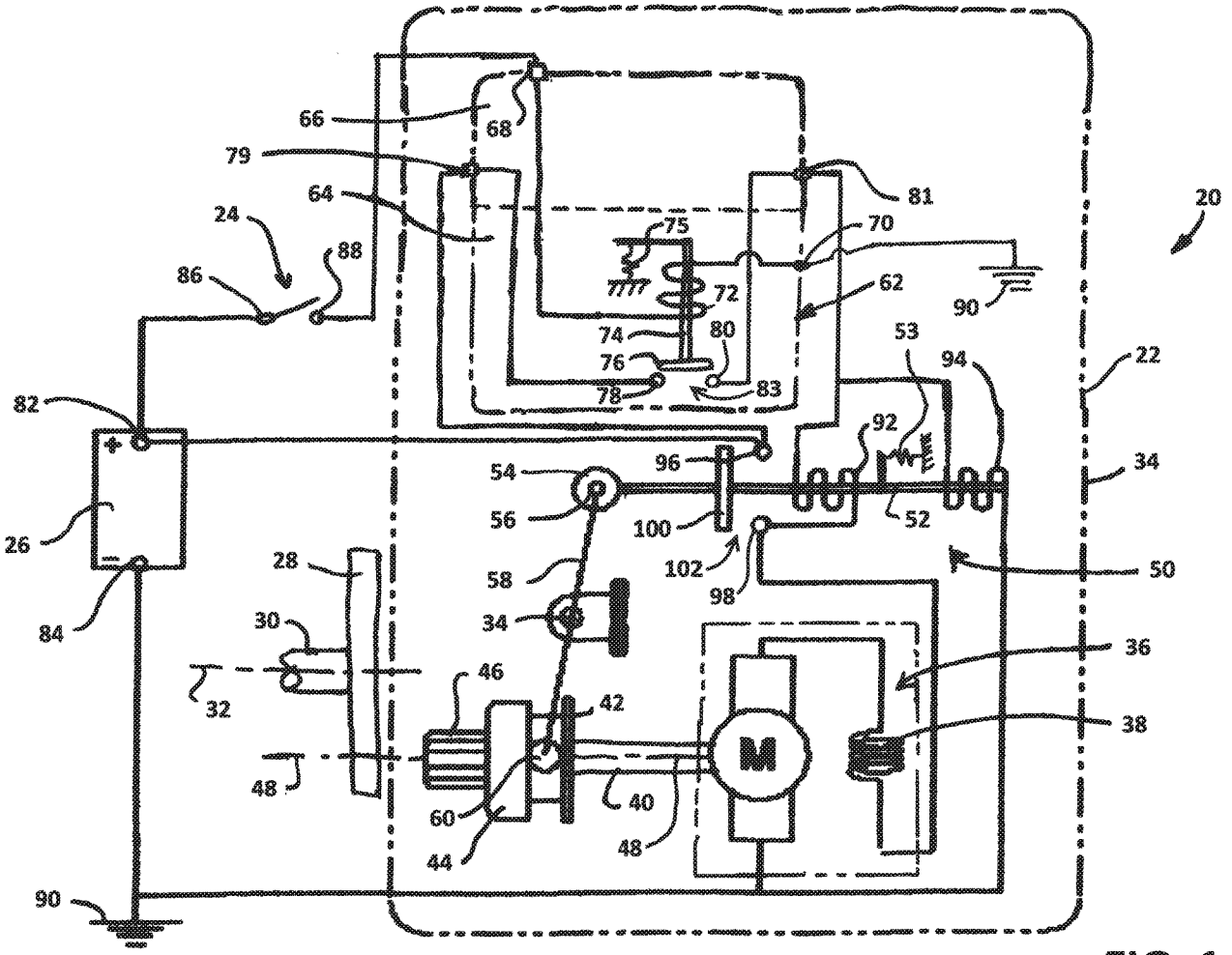
FIG. 1 (Prior Art)
FIG. 1 is a schematic of an embodiment of a prior conventional starter system.

Corresponding reference characters indicated corresponding parts throughout the several views. Although the drawings represent embodiments of the disclosed apparatus, the drawings are not necessarily to scale or to the same scale and certain features may be exaggerated in order to better illustrate and explain the present disclosure.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 2:
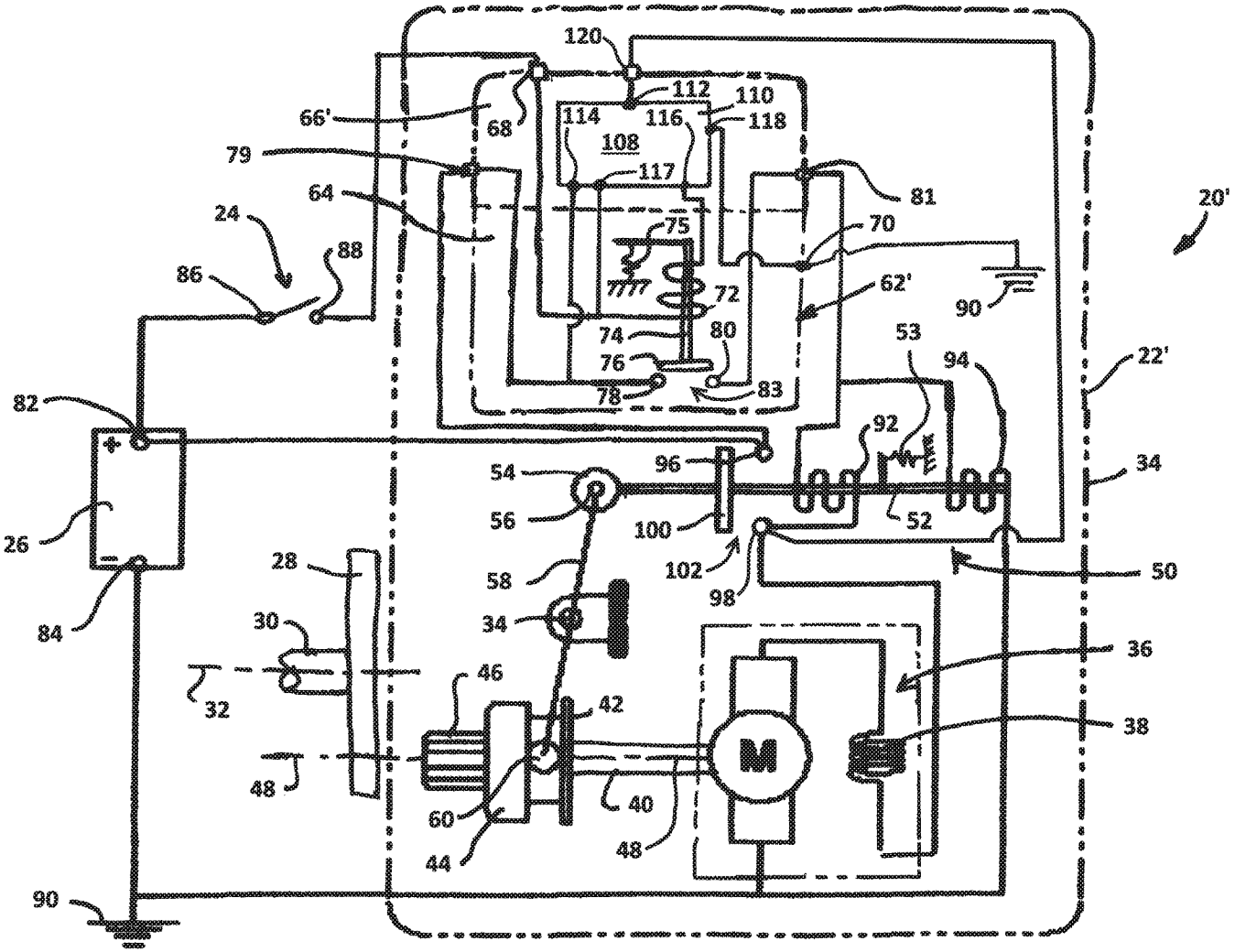
FIG. 2 is a schematic of an embodiment of a conventional starter system according to the present disclosure.

In referring below and in the drawings to a starter system or device according to the present disclosure, its elements corresponding to elements of the prior art starter system or device discussed above are identified with a like reference numeral primed. Thus, for example, an embodiment of above-discussed starter system 20 and starter assembly 22 modified in accordance with the present disclosure is identified as starter system 20' and starter assembly 22'. Corresponding elements of system 20' or starter assembly 22' that are substantially unchanged relative to above-discussed prior system 20 or starter assembly 22 are identified with common respective element numerals. FIG. 2 schematically shows one embodiment of starter system 20' according to the present disclosure that is substantially similar to prior starter system 20 except as herein disclosed.

Figure 3:
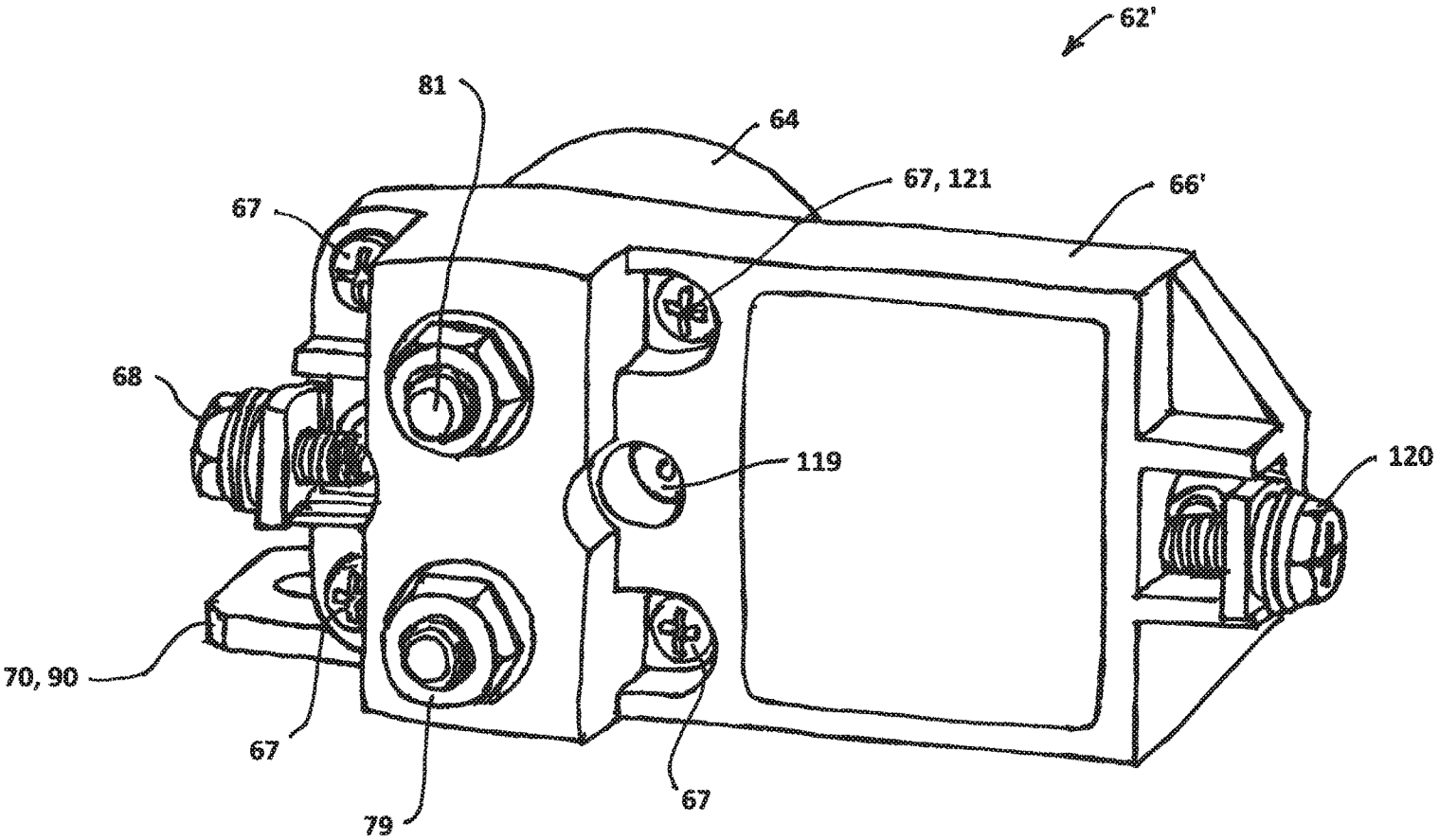
FIG. 3 is a perspective view of an embodiment of a starter relay switch usable in the starter system of FIG. 2.

Starter system 20' includes starter assembly 22' including intelligent integral magnetic switch assembly (or iIMS) 62' shown in FIG. 3. Like IMS 62, iIMS 62' includes electromagnetically-closed relay switch 83, and may be included as an attached component of its starter assembly 22'. Starter system 20' may include starter assembly 22' and iIMS 62' as a unitary assemblage, i.e., as a single unit comprised of the assembled parts, which are together commercialized or installed in a vehicle. Such an assemblage may also be referred to as a unitary starter assembly.

Starter relay switch 62' has switch cover 66' which is interchangeable with prior starter relay switch cover 66. Thus, certain embodiments of starter relay switch 62' have switch cover 66' mated to housing 64 of prior starter relay switch 62. Switch cover 66' includes a plurality of screws 67 for attaching switch cover 66' to housing 64. As in the case of depicted prior starter relay switch 62, grounding terminal 70 of the depicted embodiment of starter relay switch 62' is connected to ground 90 through the attachment of switch housing 64 to housing/frame structure 34 of starter assembly 22', which is also grounded. Those having ordinary skill in the relevant art will recognize, however, that grounding terminal 70 may be insulated from switch housing 64 and separately grounded.

Starter relay switch 62' includes integrated controller 108 provided on printed circuit board ("PCB") 110, which is mounted to the interior of switch cover 66'. PCB 110 is provided with M terminal 112, B+ terminal 114, S− terminal 116, S+ terminal 117, and ground terminal 118. Switch cover 66' includes rivet 119 which is connected to S− terminal 116. Referring again to FIG. 2, M terminal 112 is electrically connected to input terminal 120 of switch cover 66' for monitoring (or sensing) applied motor voltage. In the depicted embodiment, input terminal 120 is electrically connected to second solenoid switch contact 98. B+ terminal 114 is electrically connected to first switch terminal 79 of switch cover 66' for monitoring battery voltage applied to first switch contact 78 and, with relay switch 83 closed, to second switch contact 80 and second switch terminal 81.

S− terminal 116 is electrically connected to the low or downstream current side of relay switch activation coil 72 for monitoring voltage at this location, whereas S+ terminal 117 is electrically connected to the high or upstream current side of relay switch activation coil 72 for monitoring voltage at this location and at relay switch activation terminal 68, which is electrically connected to second key switch contact 88.

Ground terminal 118 is electrically connected to grounding terminal 70, which is electrically connected to the interior metallic switch housing 64 which, as mentioned above, is connected to ground 90 through the attachment of iIMS 62' to motor housing 34 of starter assembly 22', which is also grounded. As also mentioned above, those having ordinary skill in the relevant art will recognize that grounding terminal 70 may instead be insulated from switch housing 64 and separately grounded. Additionally, the various grounds 121 of controller 108 are electrically connected to ground terminal 118 and starter system ground 90. At least one of screws 67 is also connected to ground 121. As discussed further below, controller 108 selectively permits or prevents current flow through relay switch activation coil 72, thereby controlling, on the basis of time and monitored conditions, the opening and closing of relay switch 83. Consequently, the operation of starter assembly 22' is regulated by controller 108 of iIMS 62', which may thus be understood to provide a starter system-controlling relay switch.

Figure 4:
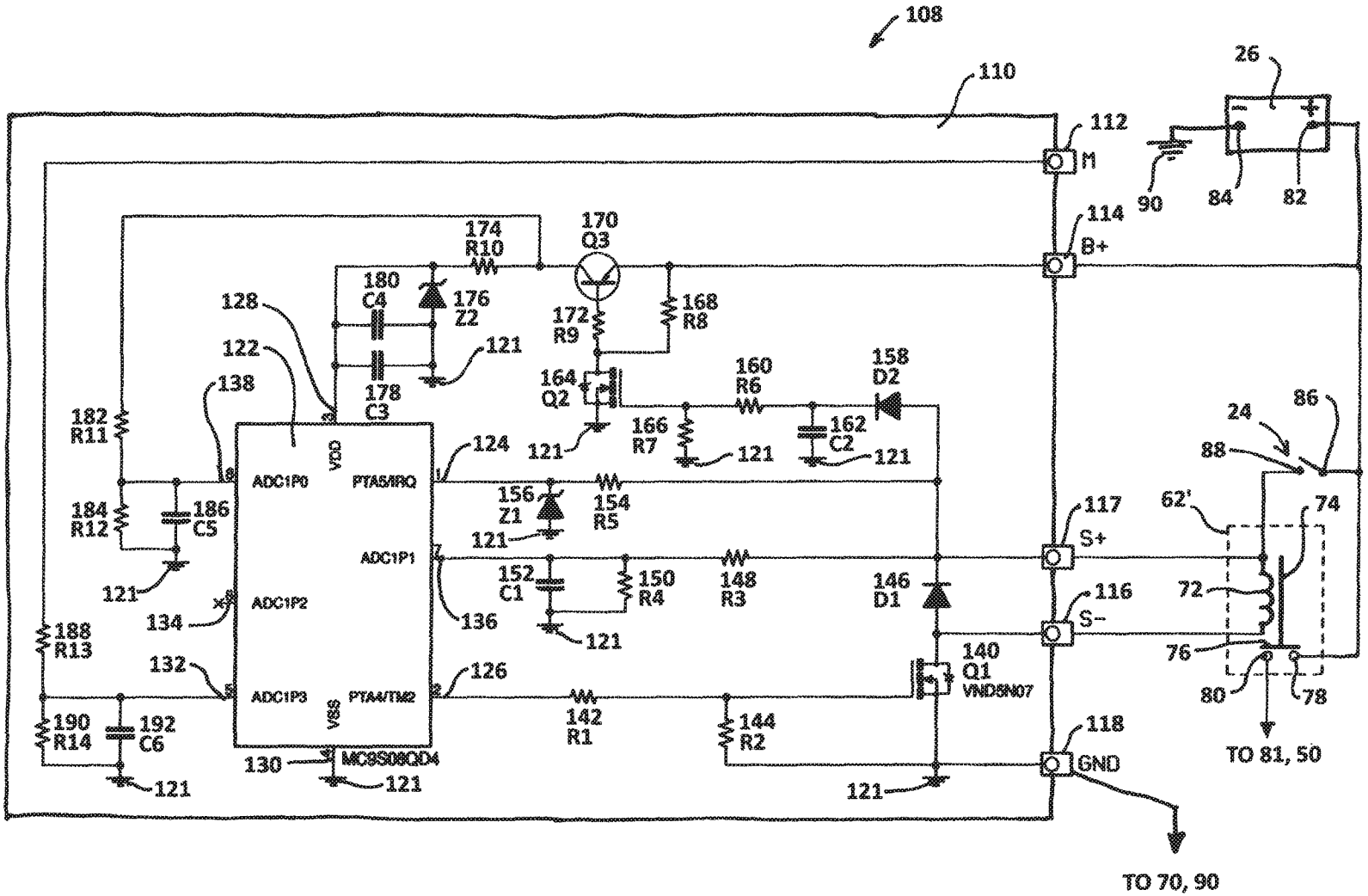
FIG. 4 is a first schematic of a controller integrated into the starter relay switch of FIG. 3.
Figure 5:
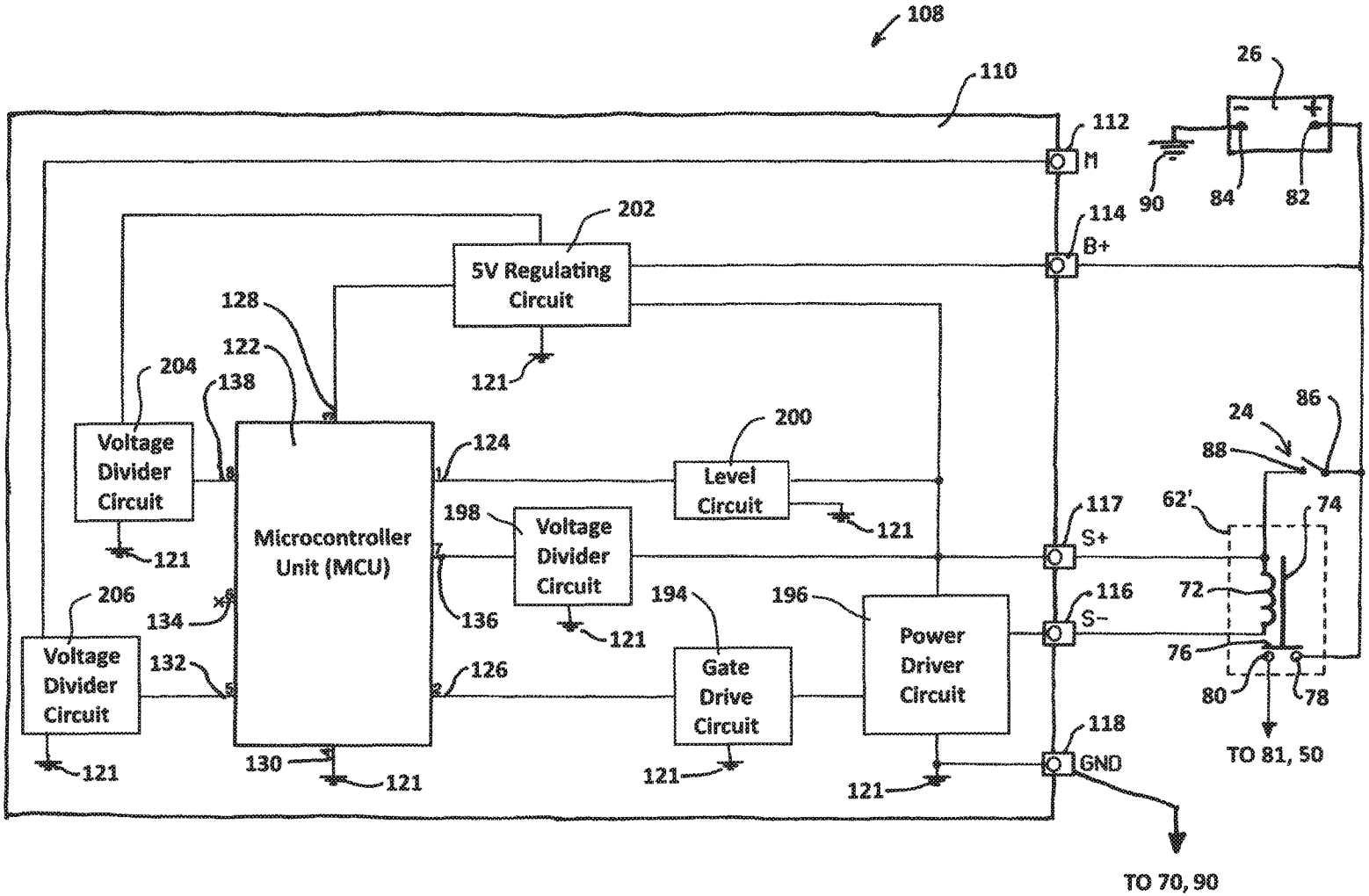
FIG. 5 is a second schematic of the controller of FIG. 4, wherein portions of the controller circuit there shown are represented as individual functional circuits.

FIGS. 4 and 5 show related schematic views of controller 108, indicating portions of starter relay switch 62' and other components of starter system 20' with which it operably communicates. Where mentioned in the following discussion, resistor and capacitor first terminals are those oriented towards the top or right hand side of FIG. 4, and their second terminals are oriented towards the bottom or left hand side of that Figure. Respective exemplary values for each resistor and capacitor are shown in FIG. 4, but may be deviated from to provide desired adjustments to the operation of starter system 20' and to accommodate different system voltages (e.g., 12V or 24V) and characteristics of various starter system components.

Controller 108 includes microcontroller unit ("MCU") 122 which may, for example, be a model MC9S08QD4 MCU commercially available from Freescale Semiconductor headquartered in Austin, Tex., USA. This particular MCU includes 256B RAM, integrated flash memory programmable in circuit, an analogue-to-digital converter, dual 16 bit timer modules, an internal clock source module, and eight (8) terminals or pins identified as follows: pin 1 (PTA5/IRQ) 124; pin 2 (PTA4/TM2) 126; pin 3 (VDD) 128; pin 4 (VSS) 130; pin 5 (ADC1P3) 132; pin 6 (ADC1P2) 134 which in the depicted embodiment is unconnected to other circuit portions of controller 108; pin 7 (ADC1P1) 136; and pin 8 (ADC1P0) 138. As mentioned further below, MCU 122 may be flashed to provide initial or revised programmed instructions for operating starter system 20'. The operating instructions programmed into the memory of MCU 122 define a starter system operating paradigm. At least one starter system operational parameter (e.g., a voltage or current level or signal) is monitored by controller 108 and provided as an input to the paradigm, by which the paradigm determines a resultant starter system operational output. In one embodiment, the resultant starter system operational output is effected by selectively completing or interrupting controller 108 circuit(s), respectively permitting or preventing current flow through relay switch activation coil 72, and consequently closing or opening starter relay switch 62'.

S−terminal 116 is connected to the drain of first transistor Q1 140, a power MOSFET including the shown Zener diode and which may, for example, be a model VND5N07 OMNIFET II commercially available from STMicroelectronics headquartered in Geneva, Switzerland. The source of first transistor Q1 140 is connected to ground 121. The input gate of first transistor Q1 140 is attached to the first terminal of first resistor R1 142. The second terminal of first resistor R1 142 is connected to MCU pin 2 126. The first terminal of second resistor R2 144 is connected to the input gate of first transistor Q1 140 and to the first terminal of first resistor R1 142. The second terminal of second resistor R2 144 is connected to ground 121.

The anode of first diode D1 146 is connected to the drain of first transistor Q1 140 and to S− terminal 116. The cathode of first diode D1 146 is connected to S+ terminal 117 and to the first terminal of third resistor R3 148. The second terminal of third resistor R3 148 is connected to MCU pin 7 136. Connected to MCU pin 7 136 and to the second terminal of third resistor R3 148 are the first terminals of parallel-connected fourth resistor R4 150 and first capacitor C1 152. The second terminals of parallel-connected fourth resistor R4 150 and first capacitor C1 152 are connected to ground 121. The cathode of first diode D1 146 is also connected to the first terminal of fifth resistor R5 154.

The second terminal of fifth resistor R5 154 is connected to MCU pin 1 124. Also connected to the second terminal of fifth resistor R5 154 and to MCU pin 1 124 is the cathode of first Zener diode Z1 156. The anode of first Zener diode Z1 156 is connected to ground 121.

The cathode of first diode D1 146 is also connected to the anode of second diode D2 158. The cathode of second diode D2 158 is connected to the first terminal of sixth resistor R6 160. Also connected to the first terminal of sixth resistor R6 160 and to the cathode of second diode D2 158 is the first terminal of second capacitor C2 162. The second terminal of second capacitor C2 162 is connected to ground 121. The second terminal of sixth resistor R6 160 is connected to the input gate of second transistor Q2 164 which may be identical to above-described first transistor Q1 140. Also connected to the second terminal of sixth resistor R6 160 and to the input gate of second transistor Q2 164 is the first terminal of seventh resistor R7 166. The second terminal of seventh resistor R7 166 is connected to ground 121. The source of second transistor Q2 164 is connected to ground 121.

B+ terminal 114 is connected to the non-inverting input of third transistor Q3 170 which may, for example, be a model MMBT5401 150V/500 mA PNP transistor commercially available from ON Semiconductor headquartered in Phoenix, Ariz., USA. Also connected to B+ terminal 114 and to the non-inverting input of third transistor Q3 170 is the first terminal of eighth resistor R8 168. The second terminal of eighth resistor R8 168 is connected to the drain of second transistor Q2 164. The collector of third transistor Q3 170 is connected to the first terminal of ninth resistor R9 172. The second terminal of ninth resistor R9 172 is connected to the second terminal of eighth resistor R8 168 and to the drain of second transistor Q2 164. The inverting output of third transistor Q3 170 is connected to the first terminal of tenth resistor R10 174. The second terminal of tenth resistor R10 174 is connected to MCU pin 3 128. Also connected to the second terminal of tenth resistor R10 174 and to MCU pin 3 128 is the cathode of second Zener diode Z2 176. The anode of second Zener diode Z2 176 is connected to ground 121. The grounded anode of second Zener diode Z2 176 is also connected to the first terminals of parallel-connected third and fourth capacitors C3 178, C4 180. The second terminals of parallel-connected third and fourth capacitors C3 178, C4 180 are connected to the cathode of second Zener diode Z2 176 and to MCU pin 3 128.

Connected to the inverting output of third transistor Q3 170 and to the first terminal of tenth resistor R10 174 is the first terminal of eleventh resistor R11 182. The second terminal of eleventh resistor R11 182 is attached to MCU pin 8 138. Also connected to both the second terminal of eleventh resistor R11 182 and MCU pin 8 138 are the first terminals of parallel-connected twelfth resistor R12 184 and fifth capacitor C5 186. The second terminals of parallel-connected twelfth resistor R12 184 and fifth capacitor C5 186 are connected to ground 121.

M terminal 112 is connected to the first terminal of thirteenth resistor R13 188. The second terminal of thirteenth resistor R13 188 is connected to MCU pin 5 132. Connected to the second terminal of thirteenth resistor R13 188 and to MCU pin 5 132 are the first terminals of parallel-connected fourteenth resistor R14 190 and sixth capacitor C6 192. The second terminals of parallel-connected fourteenth resistor R14 190 and sixth capacitor C6 192 are connected to ground 121.

Exemplary sizes of the resistors and capacitors of control 108 shown in FIG. 4 for a 24V starter system 20' are shown below in Table 1.

TABLE 1

| Resistor or Capacitor | Reference Numeral | Resistor/Capacitor Size |
|---|---|---|
| R1 | 142 | 1.5 KΩ |
| R2 | 144 | 30 KΩ |
| R3 | 148 | 180 KΩ |
| R4 | 150 | 30 KΩ |
| R5 | 154 | 30 KΩ |
| R6 | 160 | 2.2 MΩ |
| R7 | 166 | 5.1 MΩ |
| R8 | 168 | 30 KΩ |
| R9 | 172 | 30 KΩ |
| R10 | 174 | 820 Ω |
| R11 | 182 | 180 KΩ |
| R12 | 184 | 30 KΩ |
| R13 | 188 | 180 KΩ |
| R14 | 190 | 30 KΩ |
| C1 | 152 | 0.1 μF |
| C2 | 162 | 2.2 μF |
| C3 | 178 | 0.1 μF |
| C4 | 180 | 10 μF |
| C5 | 186 | 0.1 μF |
| C6 | 192 | 0.1 μF |

Those having ordinary skill in the relevant art will recognize that interconnected portions of the circuit shown in FIG. 4 and described above form functional circuits of controller 108:

First and second resistors R1 142, R2 144 define gate drive circuit 194.

First transistor Q1 140 and first diode D1 146 define power driver circuit 196.

Third resistor R3 148, fourth resistor R4 150, and first capacitor C1 152 define voltage divider circuit 198.

Fifth resistor R5 154 and first Zener diode Z1 156 define level circuit 200.

Second diode D2 158, sixth resistor R6 160, second capacitor C2 162, second transistor Q2 164, seventh resistor R7 166, eighth resistor R8 168, third transistor Q3 170, ninth resistor R9 172, tenth resistor R10 174, second Zener diode Z2 176, third capacitor C3 178, and fourth capacitor C4 180 define 5V regulating circuit 202.

Eleventh resistor R11 182, twelfth resistor R12 184, and fifth capacitor C5 186 define voltage divider circuit 204.

Thirteenth resistor R13 188, fourteenth resistor R14 190, and sixth capacitor C6 192 define voltage divider circuit 206.

The enumerated pins of MCU 122 thus individually communicate with different ones of the abovementioned functional circuits, as shown in FIG. 5:

MCU pin 1 (PTA5/IRQ) 124 is connected to level circuit 200;

MCU pin 2 (PTA4/TM2) 126 is connected to gate drive circuit 194;

MCU pin 3 (VDD) 128 is connected to 5V regulating circuit 202;

MCU pin 4 (VSS) 130 is connected to ground 121;

MCU pin 5 (ADC1P3) 132 is connected to voltage divider circuit 206;

MCU pin 6 (ADC1P2) 134 is, in the depicted embodiment, unconnected;

MCU pin 7 (ADC1P1) 136 is connected to voltage divider circuit 198; and MCU pin 8 (ADC1P0) 138 is connected to voltage divider circuit 204.

FIG. 6 shows which of these functional circuits of controller 108 are utilized with MCU 122 in starter system 20' for controlling operational features that prevent certain failure modes. It is to be understood that some embodiments of starter system 20' and controller 108 may provide some but not all features in various combinations, depending on design and/or performance preferences of, for example, the vehicle OEM or a particular customer. Such combinations may be effected through circuit design or by flashing MCU 122 to initially establish or alter the programming of controller 108, whereby starter relay switch 62' may be selectively adapted to provide any or all of the features (or functions) listed in FIG. 6.

Referring to FIG. 6, starter engagement monitoring and automatic retry feature 216 corrects occurrences of "click-no-crank" events and prevents prolonging power application to the solenoid. Feature 216 employs MCU 122 and the following functional circuits of controller 108: gate drive circuit 194, power driver circuit 196, voltage divider circuit 198, level circuit 200, 5V regulating circuit 202, voltage divider circuit 204, and voltage divider circuit 206, to recycle power application to solenoid assembly pull-in and hold-in coils 92, 94 if, in a 24V system, motor voltage at M terminal 112 falls below 11.0V or, more preferably, 6.0V within a predetermined time period of 600 ms, and limits starter operation to three (3) consecutive retry events in the starter switch 24 closed condition, i.e., during a starting operation. In a 12V system, electrical power application to pull-in and hold-in coils 92, 94 is similarly recycled to when the monitored motor energization voltage at M terminal 112 falls below 6.0V or, more preferably, 4.0V within a predetermined time period of no more than 600 ms. For either a 24V or 12V starter system, it may be preferable to reduce the predetermined time period to no more than 150 ms to correct the "click-no-crank" occurrence as quickly as possible.

A recycle of electrical power application to the solenoid assembly entails, during a starting operation, using the controller 108 for opening relay switch 83 to cut power to solenoid assembly pull-in and hold-in coils 92, 94, waiting a predetermined time delay period, and then reclosing relay switch 83 to repeatedly provide electrical power application to the solenoid assembly pull-in and hold-in coils 92, 94. To ensure that the electrical current is not applied to the solenoid assembly pull-in and hold-in coils 92, 94 for an extended period of time, which can result in overheating the solenoid assembly, the predetermined time delay period should be a value less than 600 ms.

Moreover, the predetermined time delay period between opening relay switch 83 to cut electrical power to solenoid assembly pull-in and hold-in coils 92, 94, and reclosing relay switch 83 to reapply electrical power to these coils, to respectively deactivate and reactivate solenoid assembly 50 during a starting operation, is desirably set control the axial travel of pinion 46 from ring gear 28. It is desirable that pinion 46, once leaving axially abutting engagement with the face of ring gear 28 after deactivation of solenoid assembly 50, is optionally prevented from returning to its "home" or fully-disengaged position during the predetermined time delay period. Preventing pinion 46 from reaching the fully disengaged position during the delay period reduces the reengagement time for quicker starting since the pinion need not travel as far, and also reduces wear on the pinion and ring gear because re-contacting forces on their faces when again abutted during reactivation of the solenoid assembly are lower than would occur were pinion 46 to travel from its home position toward ring gear 28.

In some embodiments, the predetermined time delay period is so short as to prevent pinion 46 leaving abutting engagement with ring gear 28—their faces remain in contact. The time delay period may be just long enough to relax the pinion on the ring gear, and reduce compressive forces therebetween. Thus, upon reactivation of solenoid assembly 50, no re-abutment between the pinion and the ring gear occurs, which desirably reduces wear do to re-contacting forces between the pinion and the ring gear, reduces their reengagement time for quicker starting, and reduces noise because no additional "click" occurs. The predetermined time delay period in such an embodiment may be less than 100 ms, and preferable for correcting a "click-no-crank" occurrence as quickly as possible.

Rapid starter re-engagement lockout feature 208 prevents damage to the pinion and ring gear teeth. Feature 208 employs MCU 122 and the following functional circuits of controller 108: gate drive circuit 194, voltage divider circuit 198, level circuit 200, 5V regulating circuit 202, and voltage divider circuit 204, to provide a delay of, for example, three (3) seconds, before reactivation of starter relay switch assembly 62', which again closes relay switch 83.

Running engine starter lockout feature 210 prevents starter engagement with the running engine, and damage to the pinion and ring gear teeth. Feature 210 employs MCU 122 and the following functional circuits of controller 108: gate drive circuit 194, power driver circuit 196, level circuit 200, 5V regulating circuit 202, and voltage divider circuit 204. In a 24V starter system, the running engine starter lockout feature 210 locks-out starter assembly operation if sensed battery voltage at B+ terminal 114 is greater than 26.0V, a predetermined threshold voltage indicative of the engine running and the alternator charging.

Low voltage starter lockout feature 212 prevents over-cranking and solenoid chatter. Feature 212 employs MCU 122 and the following functional circuits of controller 108: gate drive circuit 194, power driver circuit 196, voltage divider circuit 198, level circuit 200, 5V regulating circuit 202, and voltage divider circuit 204. In a 24V starter system, the low voltage starter lockout feature 212 blocks starting attempts if open circuit voltage at B+ terminal 114 is less than or equal to 24.0V. Also, a starting attempt is aborted if voltage at B+ terminal 114 drops below 10.0V (in a 24V system) during cranking.

Time-limited starter cranking feature 214 prevents over-cranking. Feature 214 employs MCU 122 and the following functional circuits of controller 108: gate drive circuit 194, power driver circuit 196, voltage divider circuit 198, level circuit 200, 5V regulating circuit 202, and voltage divider circuit 204, to provide a maximum continuous cranking period of 20 seconds, with a ten (10) second delay between starting attempts.

Automatic starter disengagement at engine start feature 218 prevents extended starter overrun. Feature 218 employs MCU 122 and the following functional circuits of controller 108: gate drive circuit 194, power driver circuit 196, voltage divider circuit 198, level circuit 200, 5V regulating circuit 202, and voltage divider circuit 204. Closing starter switch 24 commences a starting operation and applies voltage to activation coil 72. That voltage is sensed upstream of activation coil 72 and monitored by controller 108 via S+ terminal 117. Prior to controller 108 permitting grounding of current through activation coil 72 which will electromagnetically close relay switch 83 against the biasing force of spring 75, the sensed voltage input to S+ terminal 117 will have a nominal level approximating battery voltage (e.g., about 24.0V). Upon controller 108 permitting grounding of current through activation coil 72 and the consequent closing of relay switch 83, the sensed voltage input to S+ terminal 117 will drop below that nominal level temporarily, but rise to return (or "rebound") to at least a predetermined 24.0V threshold level upon the engine starting as the engine-driven alternator increases battery voltage. Though the operator holds starter switch 24 closed after engine starting, automatic starter disengagement at engine start feature 218 acts to interrupt grounding of activation coil 72 when voltage sensed at S+ terminal 117 rebounds to 24.0V. Consequently, relay switch 83 of starter relay switch assembly 62' is opened under the unopposed biasing force of spring 75, which de-energizes solenoid coils 92 and 94. Compression spring 53 thus urges pinion 46 out of its engaged position and into a disengaged position.

Figure 7:
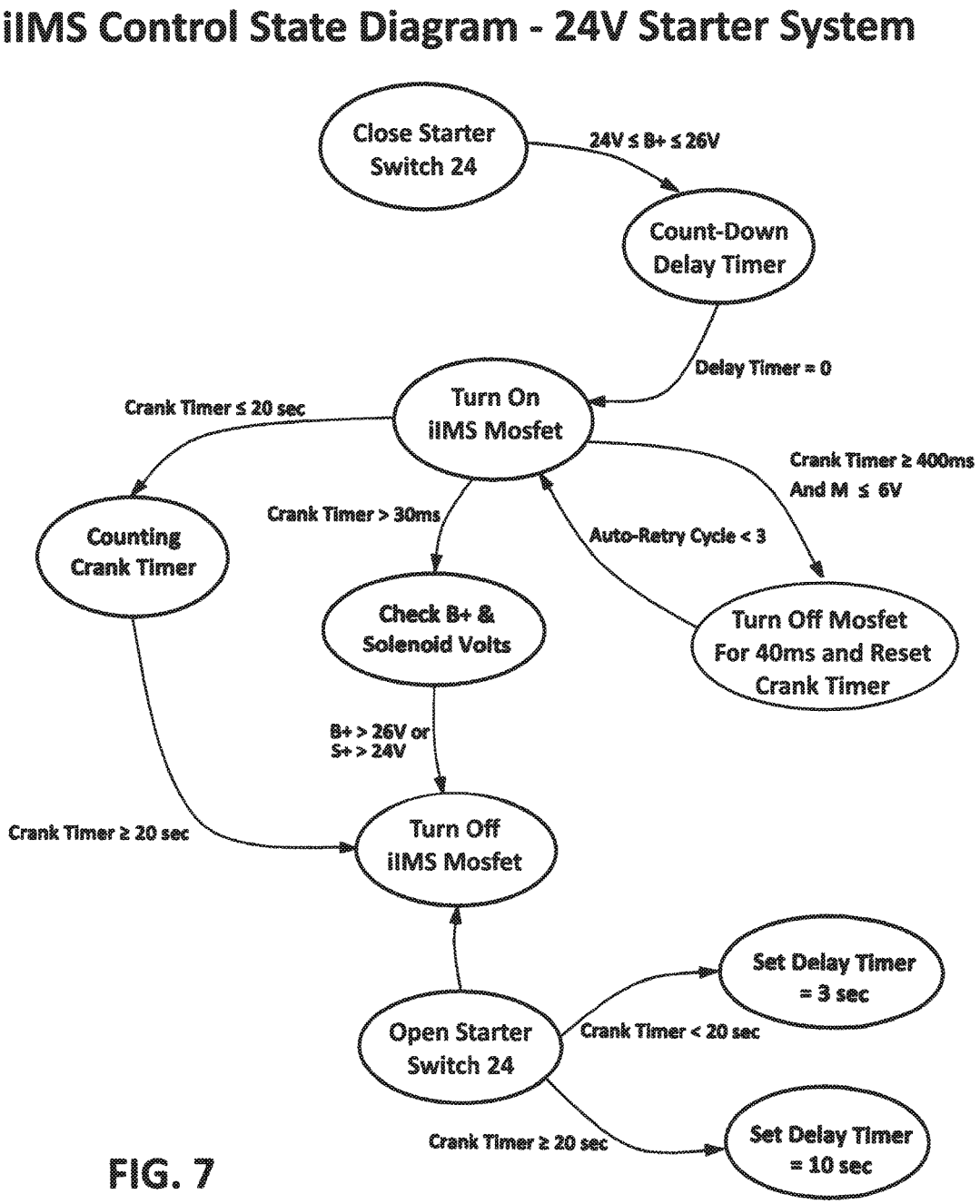
FIG. 7 is a control state diagram for a 24V starter system embodiment according to the present disclosure.

FIG. 7 shows a control state diagram for a 24V starter system 20' having an embodiment of starter relay switch assembly (or iIMS) 62'.

The following is a list of embodiments according to the present disclosure:

1. A system for starting an engine, including a relay switch that is closed during a starting operation and a starter assembly. The starter assembly includes a solenoid assembly including a solenoid switch adapted for connection to an electrical power source, a motor connected to the solenoid switch and energized by the electrical power source when the solenoid switch is closed, and a pinion rotatably coupled to the motor and moveable between an engaged position in which the engine may be cranked by the starter assembly and a disengaged position. The system also includes a controller connected to the relay switch. During a starting operation, if sensed motor energization voltage monitored by the controller falls below a predetermined threshold level within a predetermined time period after the application of electrical power to the solenoid assembly, the controller opens and recloses the relay switch to switch electrical power to the solenoid assembly off and on, whereby a "click-no-crank" event can be corrected during the starting operation.

2. The system of preferred embodiment 1, wherein the controller is configured to switch electrical power to the solenoid assembly off and on by opening the relay switch, and waiting a predetermined time delay period before reclosing the relay switch. Optionally, the pinion does not enter a fully disengaged position prior to the controller reclosing the relay switch.

3. The system of preferred embodiment 2, wherein the predetermined time delay period is a value less than 600 ms.

4. The system of preferred embodiment 3, wherein the predetermined time delay period is a value less than 100 ms.

5. The system of preferred embodiment 1, wherein the system is defined as a 24V starter system and the predetermined threshold level is a value less than 11.0V.

6. The system of preferred embodiment 5, wherein the system is defined as a 24V starter system and the predetermined threshold level is a value less than 6.0V.

7. The system of preferred embodiment 1, wherein the system is defined as a 12V starter system and the predetermined threshold level is a value less than 6.0V.

8. The system of preferred embodiment 7, wherein the system is defined as a 12V starter system and the predetermined threshold level is a value less than 4.0V.

9. The system of preferred embodiment 1, wherein the predetermined time period is a value no more than 600 ms.

10. The system of preferred embodiment 9, wherein the predetermined time period is a value no more than 150 ms.

11. The system of preferred embodiment 1, wherein the controller limits the number of times the relay switch is opened and reclosed to switch electrical power to the solenoid assembly off and on during the starting operation.

12. The system of preferred embodiment 1, wherein the relay switch is biased open and electromagnetically closed, and the system further comprises an activation coil to which voltage is applied during each starting operation. During a starting operation the controller selectively permits grounding of current through the activation coil to close the relay switch and prevents grounding of current through the activation coil to open the relay switch, and the controller regulates the relay switch through the selective grounding of the activation coil.

13. The system of preferred embodiment 12, wherein the pinion is biased into its disengaged position in the absence of electrical power application to the solenoid assembly. The controller monitors sensed voltage applied to the activation coil and during a starting operation opens the relay switch when the sensed voltage applied to the activation coil rises to a threshold voltage level, whereby the pinion is automatically moved to the disengaged position upon the engine starting.

14. The system of preferred embodiment 12, further including a momentary starter switch biased open and closed through operator actuation to commence each starting operation, wherein voltage is applied to the activation coil only when the momentary starter switch is closed.

15. The system of preferred embodiment 1, wherein the controller includes a plurality of functional circuits selectively interconnected in accordance with a starter system paradigm for regulating the relay switch.

16. The system of preferred embodiment 15, wherein the functional circuits include a gate drive circuit, a power driver circuit, a level circuit, a regulating circuit and a plurality of voltage divider circuits.

17. The system of preferred embodiment 1, wherein the system is for installation in a vehicle including the engine and a battery comprising the electrical power source. The system is operable independently of other vehicle control systems and without the controller monitoring a signal indicative of an engine speed, whereby the system defines a stand-alone starter system adapted for installation in a vehicle separately from other vehicle control systems.

18. The system of preferred embodiment 1, wherein the controller monitors time elapsed after commencement of a starting operation and delays permitting reclosing the relay switch, whereby rapid re-engagement of the pinion and the engine is prevented.

19. The system of preferred embodiment 1, wherein the electrical power source is a battery. The controller monitors sensed battery voltage and prevents the relay switch closing if the sensed battery voltage is greater than a predetermined threshold voltage, whereby starter assembly operation is prevented while the engine is running.

20. The system of preferred embodiment 1, wherein the electrical power source is a battery. The controller monitors sensed battery voltage with the solenoid switch open and prevents the relay switch closing if the sensed battery voltage is no greater than a predetermined threshold voltage, whereby starter assembly operation is prevented if the sensed battery voltage is below the threshold voltage.

21. The system of preferred embodiment 1, wherein the electrical power source is a battery. The controller monitors sensed battery voltage with the solenoid switch closed and opens the relay switch if the sensed battery voltage drops below a threshold voltage while the motor is energized, whereby the present starting attempt is aborted if battery voltage becomes lower than the threshold voltage during engine cranking.

22. The system of preferred embodiment 1, wherein the controller monitors time elapsed after commencement of a starting operation, limits the maximum duration of an application of electrical power to the solenoid assembly to a first predetermined time period, and delays occurrences of consecutive starting operations by a second predetermined time period, whereby continuous cranking time and the frequency of starting operations are limited.

23. The system of preferred embodiment 1, wherein the starter assembly, the relay switch and the controller define a unitary assemblage.

24. A unitary starter assembly including a relay switch that is closed during a starting operation, a solenoid assembly including a solenoid switch adapted for connection to an electrical power source, a motor connected to the solenoid switch and energized by the electrical power source when the solenoid switch is closed, and a pinion rotatably coupled to the motor and moveable between an engaged position in which the engine may be cranked by the starter assembly and a disengaged position. The starter system also includes a controller connected to the relay switch, and during a starting operation, if sensed motor energization voltage monitored by the controller falls below a predetermined threshold level within a predetermined time period after the application of electrical power to the solenoid assembly, the controller opens and recloses the relay switch to switch electrical power to the solenoid assembly off and on, whereby a "click-no-crank" event can be corrected during the starting operation.

25. The starter assembly of preferred embodiment 24, wherein the controller limits the number of times the relay switch is opened and reclosed to switch electrical power to the solenoid assembly off and on during the starting operation.

26. The starter assembly of preferred embodiment 24, wherein the controller includes a plurality of functional circuits selectively interconnected in accordance with a starter system paradigm for regulating the relay switch. The functional circuits include a gate drive circuit, a power driver circuit, a level circuit, a regulating circuit and a plurality of voltage divider circuits.

27. The starter assembly of preferred embodiment 24, wherein the relay switch is biased open and electromagnetically closed, and the starter assembly further includes an activation coil to which voltage is applied during each starting operation. During a starting operation the controller selectively permits grounding of current through the activation coil to close the relay switch and prevents grounding of current through the activation coil to open the relay switch. The controller regulates the relay switch through the selective grounding of the activation coil.

28. The starter assembly of preferred embodiment 27, wherein the starter assembly is adapted for attachment to the engine of a vehicle having a battery that comprises the electrical power source. The starter assembly is adapted for connection to a momentary starter switch biased open and closed through operator actuation to commence each starting operation, and voltage is applied to the activation coil only when the momentary starter switch is closed. The starter assembly is operable independently of other vehicle control systems and without the controller receiving a signal indicative of an engine speed, whereby the starter assembly and the connected operator-actuable starter switch define a stand-alone starter system adapted for installation in a vehicle separately from other vehicle control systems.

29. The starter assembly of preferred embodiment 27, wherein the controller is configured to switch electrical power to the solenoid assembly off and on by opening the relay switch, and waiting a predetermined time delay period before reclosing the relay switch. Optionally, the pinion does not enter a fully disengaged position prior to the controller reclosing the relay switch.

30. The system of preferred embodiment 29, wherein the system is defined as a 24V starter system and wherein the predetermined threshold level is a value less than 11.0V.

31. The system of preferred embodiment 29, wherein the system is defined as a 12V starter system and wherein the predetermined threshold level is a value less than 6.0V.

32. A method for regulating a starter system, including: providing electrical power to a relay switch; commencing a starting operation with an operator-actuable starter switch; using a controller during the starting operation to close the relay switch for applying electrical power to a solenoid assembly; using the powered solenoid assembly to urge a pinion rotatable by an energized motor toward an engaged position in which the engine may be cranked using the starter system, and to connect the motor to an energizing electrical power source through a solenoid switch closed when the pinion is in the engaged position; and using the controller to monitor sensed motor energization voltage and for opening and reclosing the relay switch during the starting operation to switch electrical power to the solenoid assembly off and on if sensed motor energization voltage falls below a predetermined threshold level within a predetermined time period after the application of electrical power to the solenoid assembly, whereby a "click-no-crank" event can be corrected during the starting operation.

33. A system for starting an engine, including a relay switch that is closed during a starting operation and a starter assembly. The starter assembly includes a solenoid assembly including a solenoid switch adapted for connection to an electrical power source, a motor connected to the solenoid switch and energized by the electrical power source when the solenoid switch is closed, and a pinion rotatably coupled to the motor and moveable between an engaged position in which the engine may be cranked by the starter assembly and a disengaged position. The system also includes a controller connected to the relay switch. The controller monitors time elapsed after commencement of a starting operation and delays permitting reclosing the relay switch, whereby rapid re-engagement of the pinion and the engine is prevented.

34. The system of preferred embodiment 33, wherein during a starting operation, if sensed motor energization voltage monitored by the controller falls below a predetermined threshold level within a predetermined time period after the application of electrical power to the solenoid assembly, the controller opens and recloses the relay switch to switch electrical power to the solenoid assembly off and on, whereby a "click-no-crank" event can be corrected during the starting operation.

35. The system of preferred embodiment 33, wherein the relay switch is biased open and electromagnetically closed, and the system further comprises an activation coil to which voltage is applied during each starting operation. During a starting operation the controller selectively permits grounding of current through the activation coil to close the relay switch and prevents grounding of current through the activation coil to open the relay switch, and the controller regulates the relay switch through the selective grounding of the activation coil.

36. The system of preferred embodiment 35, further including a momentary starter switch biased open and closed through operator actuation to commence each starting operation, wherein voltage is applied to the activation coil only when the momentary starter switch is closed.

37. The system of preferred embodiment 33, wherein the controller includes a plurality of functional circuits selectively interconnected in accordance with a starter system paradigm for regulating the relay switch.

38. The system of preferred embodiment 37, wherein the functional circuits include a gate drive circuit, a level circuit, a regulating circuit and a plurality of voltage divider circuits.

39. The system of preferred embodiment 33, wherein the system is for installation in a vehicle including the engine and a battery comprising the electrical power source. The system is operable independently of other vehicle control systems and without the controller monitoring a signal indicative of an engine speed, whereby the system defines a stand-alone starter system adapted for installation in a vehicle separately from other vehicle control systems.

40. The system of preferred embodiment 33, wherein the electrical power source is a battery. The controller monitors sensed battery voltage and prevents the relay switch closing if the sensed battery voltage is greater than a predetermined threshold voltage, whereby starter assembly operation is prevented while the engine is running.

41. The system of preferred embodiment 33, wherein the electrical power source is a battery. The controller monitors sensed battery voltage with the solenoid switch open and prevents the relay switch closing if the sensed battery voltage is no greater than a predetermined threshold voltage, whereby starter assembly operation is prevented if the sensed battery voltage is below the threshold voltage.

42. The system of preferred embodiment 33, wherein the electrical power source is a battery. The controller monitors sensed battery voltage with the solenoid switch closed and opens the relay switch if the sensed battery voltage drops below a threshold voltage while the motor is energized, whereby the present starting attempt is aborted if battery voltage becomes lower than the threshold voltage during engine cranking.

43. The system of preferred embodiment 33, wherein the controller monitors time elapsed after commencement of a starting operation, limits the maximum duration of an application of electrical power to the solenoid assembly to a first predetermined time period, and delays occurrences of consecutive starting operations by a second predetermined time period, whereby continuous cranking time and the frequency of starting operations are limited.

44. The system of preferred embodiment 1, wherein the starter assembly, the relay switch and the controller define a unitary assemblage.

45. A unitary starter assembly including a relay switch that is closed during a starting operation, a solenoid assembly including a solenoid switch adapted for connection to an electrical power source, a motor connected to the solenoid switch and energized by the electrical power source when the solenoid switch is closed, and a pinion rotatably coupled to the motor and moveable between an engaged position in which the engine may be cranked by the starter assembly and a disengaged position. The starter system also includes a controller connected to the relay switch. The controller monitors time elapsed after commencement of a starting operation and delays permitting reclosing the relay switch, whereby rapid re-engagement of the pinion and the engine is prevented.

46. The starter assembly of preferred embodiment 45, wherein the controller includes a plurality of functional circuits selectively interconnected in accordance with a starter system paradigm for regulating the relay switch. The functional circuits include a gate drive circuit, a level circuit, a regulating circuit and a plurality of voltage divider circuits.

47. The starter assembly of preferred embodiment 45, wherein the relay switch is biased open and electromagnetically closed, and the starter assembly further includes an activation coil to which voltage is applied during each starting operation. During a starting operation the controller selectively permits grounding of current through the activation coil to close the relay switch and prevents grounding of current through the activation coil to open the relay switch. The controller regulates the relay switch through the selective grounding of the activation coil.

48. The starter assembly of preferred embodiment 47, wherein the starter assembly is adapted for attachment to the engine of a vehicle having a battery that comprises the electrical power source. The starter assembly is adapted for connection to a momentary starter switch biased open and closed through operator actuation to commence each starting operation, and voltage is applied to the activation coil only when the momentary starter switch is closed. The starter assembly is operable independently of other vehicle control systems and without the controller receiving a signal indicative of an engine speed, whereby the starter assembly and the connected operator-actuable starter switch define a stand-alone starter system adapted for installation in a vehicle separately from other vehicle control systems.

49. A method for regulating a starter system, including: providing electrical power to a relay switch; commencing a starting operation with an operator-actuable starter switch; using a controller during the starting operation to close the relay switch for applying electrical power to a solenoid assembly; using the powered solenoid assembly to urge a pinion rotatable by an energized motor toward an engaged position in which the engine may be cranked using the starter system, and to connect the motor to an energizing electrical power source through a solenoid switch closed when the pinion is in the engaged position; and using the controller to monitor time elapsed after commencement of a starting operation and delays permitting reclosing the relay switch, whereby rapid re-engagement of the pinion and the engine is prevented.

50. A system for starting an engine, including a relay switch that is closed during a starting operation and a starter assembly. The starter assembly includes a solenoid assembly including a solenoid switch adapted for connection to a battery, a motor connected to the solenoid switch and energized by the battery when the solenoid switch is closed, and a pinion rotatably coupled to the motor and moveable between an engaged position in which the engine may be cranked by the starter assembly and a disengaged position. The system also includes a controller connected to the relay switch. The controller monitors sensed battery voltage and prevents the relay switch closing if the sensed battery voltage is greater than a predetermined threshold voltage, whereby starter assembly operation is prevented while the engine is running.

51. The system of preferred embodiment 50, wherein during a starting operation, if sensed motor energization voltage monitored by the controller falls below a predetermined threshold level within a predetermined time period after the application of electrical power to the solenoid assembly, the controller opens and recloses the relay switch to switch electrical power to the solenoid assembly off and on, whereby a "click-no-crank" event can be corrected during the starting operation.

52. The system of preferred embodiment 50, wherein the relay switch is biased open and electromagnetically closed, and the system further comprises an activation coil to which voltage is applied during each starting operation. During a starting operation the controller selectively permits grounding of current through the activation coil to close the relay switch and prevents grounding of current through the activation coil to open the relay switch, and the controller regulates the relay switch through the selective grounding of the activation coil.

53. The system of preferred embodiment 52, further including a momentary starter switch biased open and closed through operator actuation to commence each starting operation, wherein voltage is applied to the activation coil only when the momentary starter switch is closed.

54. The system of preferred embodiment 50, wherein the controller includes a plurality of functional circuits selectively interconnected in accordance with a starter system paradigm for regulating the relay switch.

55. The system of preferred embodiment 54, wherein the functional circuits include a gate drive circuit, a power driver circuit, a level circuit, a regulating circuit and a voltage divider circuit.

56. The system of preferred embodiment 50, wherein the system is for installation in a vehicle including the engine and a battery. The system is operable independently of other vehicle control systems and without the controller monitoring a signal indicative of an engine speed, whereby the system defines a stand-alone starter system adapted for installation in a vehicle separately from other vehicle control systems.

57. The system of preferred embodiment 50, wherein the controller monitors time elapsed after commencement of a starting operation and delays permitting reclosing the relay switch, whereby rapid re-engagement of the pinion and the engine is prevented.

58. The system of preferred embodiment 50, wherein the controller monitors sensed battery voltage with the solenoid switch open and prevents the relay switch closing if the sensed battery voltage is no greater than a predetermined threshold voltage, whereby starter assembly operation is prevented if the sensed battery voltage is below the threshold voltage.

59. The system of preferred embodiment 50, wherein the controller monitors sensed battery voltage with the solenoid switch closed and opens the relay switch if the sensed battery voltage drops below a threshold voltage while the motor is energized, whereby the present starting attempt is aborted if battery voltage becomes lower than the threshold voltage during engine cranking.

60. The system of preferred embodiment 50, wherein the controller monitors time elapsed after commencement of a starting operation, limits the maximum duration of an application of electrical power to the solenoid assembly to a first predetermined time period, and delays occurrences of consecutive starting operations by a second predetermined time period, whereby continuous cranking time and the frequency of starting operations are limited.

61. The system of preferred embodiment 1, wherein the starter assembly, the relay switch and the controller define a unitary assemblage.

62. A unitary starter assembly including a relay switch that is closed during a starting operation, a solenoid assembly including a solenoid switch adapted for connection to a battery, a motor connected to the solenoid switch and energized by the battery when the solenoid switch is closed, and a pinion rotatably coupled to the motor and moveable between an engaged position in which the engine may be cranked by the starter assembly and a disengaged position. The starter system also includes a controller connected to the relay switch. The controller monitors sensed battery voltage and prevents the relay switch closing if the sensed battery voltage is greater than a predetermined threshold voltage, whereby starter assembly operation is prevented while the engine is running.

63. The starter assembly of preferred embodiment 62, wherein the controller includes a plurality of functional circuits selectively interconnected in accordance with a starter system paradigm for regulating the relay switch. The functional circuits include a gate drive circuit, a power driver circuit, a level circuit, a regulating circuit and a voltage divider circuit.

64. The starter assembly of preferred embodiment 62, wherein the relay switch is biased open and electromagnetically closed, and the starter assembly further includes an activation coil to which voltage is applied during each starting operation. During a starting operation the controller selectively permits grounding of current through the activation coil to close the relay switch and prevents grounding of current through the activation coil to open the relay switch. The controller regulates the relay switch through the selective grounding of the activation coil.

65. The starter assembly of preferred embodiment 64, wherein the starter assembly is adapted for attachment to the engine of a vehicle having the battery. The starter assembly is adapted for connection to a momentary starter switch biased open and closed through operator actuation to commence each starting operation, and voltage is applied to the activation coil only when the momentary starter switch is closed. The starter assembly is operable independently of other vehicle control systems and without the controller receiving a signal indicative of an engine speed, whereby the starter assembly and the connected operator-actuable starter switch define a stand-alone starter system adapted for installation in a vehicle separately from other vehicle control systems.

66. A method for regulating a starter system, including: providing electrical power to a relay switch; commencing a starting operation with an operator-actuable starter switch; using a controller during the starting operation to close the relay switch for applying electrical power to a solenoid assembly; using the powered solenoid assembly to urge a pinion rotatable by an energized motor toward an engaged position in which the engine may be cranked using the starter system, and to connect the motor to an energizing battery through a solenoid switch closed when the pinion is in the engaged position; and using the controller to sensed battery voltage and prevents the relay switch closing if the sensed battery voltage is greater than a predetermined threshold voltage, whereby starter assembly operation is prevented while the engine is running.

67. A system for starting an engine, including a relay switch that is closed during a starting operation and a starter assembly. The starter assembly includes a solenoid assembly including a solenoid switch adapted for connection to a battery, a motor connected to the solenoid switch and energized by the battery when the solenoid switch is closed, and a pinion rotatably coupled to the motor and moveable between an engaged position in which the engine may be cranked by the starter assembly and a disengaged position. The system also includes a controller connected to the relay switch. The system is for installation in a vehicle including the engine and the battery. The system is operable independently of other vehicle control systems and without the controller monitoring a signal indicative of an engine speed, whereby the system defines a stand-alone starter system adapted for installation in a vehicle separately from other vehicle control systems.

68. The system of preferred embodiment 67, wherein the relay switch is biased open and electromagnetically closed, and the system further comprises an activation coil to which voltage is applied during each starting operation. During a starting operation the controller selectively permits grounding of current through the activation coil to close the relay switch and prevents grounding of current through the activation coil to open the relay switch, and the controller regulates the relay switch through the selective grounding of the activation coil.

69. The system of preferred embodiment 68, further including a momentary starter switch biased open and closed through operator actuation to commence each starting operation, wherein voltage is applied to the activation coil only when the momentary starter switch is closed.

70. The system of preferred embodiment 67, wherein during a starting operation, if sensed motor energization voltage monitored by the controller falls below a predetermined threshold level within a predetermined time period after the application of electrical power to the solenoid assembly, the controller opens and recloses the relay switch to switch electrical power to the solenoid assembly off and on, whereby a "click-no-crank" event can be corrected during the starting operation.

71. The system of preferred embodiment 67, wherein the controller includes a plurality of functional circuits selectively interconnected in accordance with a starter system paradigm for regulating the relay switch.

72. The system of preferred embodiment 71, wherein the functional circuits include a gate drive circuit, a power driver circuit, a level circuit, a regulating circuit and a plurality of voltage divider circuits.

73. The system of preferred embodiment 67, wherein the controller monitors time elapsed after commencement of a starting operation and delays permitting reclosing the relay switch, whereby rapid re-engagement of the pinion and the engine is prevented.

74. The system of preferred embodiment 67, wherein the controller monitors sensed battery voltage and prevents the relay switch closing if the sensed battery voltage is greater than a predetermined threshold voltage, whereby starter assembly operation is prevented while the engine is running.

75. The system of preferred embodiment 67, wherein the controller monitors sensed battery voltage with the solenoid switch open and prevents the relay switch closing if the sensed battery voltage is no greater than a predetermined threshold voltage, whereby starter assembly operation is prevented if the sensed battery voltage is below the threshold voltage.

76. The system of preferred embodiment 67, wherein the controller monitors sensed battery voltage with the solenoid switch closed and opens the relay switch if the sensed battery voltage drops below a threshold voltage while the motor is energized, whereby the present starting attempt is aborted if battery voltage becomes lower than the threshold voltage during engine cranking.

77. The system of preferred embodiment 67, wherein the controller monitors time elapsed after commencement of a starting operation, limits the maximum duration of an application of electrical power to the solenoid assembly to a first predetermined time period, and delays occurrences of consecutive starting operations by a second predetermined time period, whereby continuous cranking time and the frequency of starting operations are limited.

78. The system of preferred embodiment 67, wherein the starter assembly, the relay switch and the controller define a unitary assemblage.

79. A method for regulating a starter system, including: providing electrical power to a relay switch; commencing a starting operation with an operator-actuable starter switch; transitioning the relay switch from a biased-open condition to a closed condition with a controller and applying electrical power to a solenoid assembly through the relay switch in its closed condition; urging a solenoid switch connected to a battery and a motor towards a closed state in which the motor is energized by the battery during the application of electrical power to the solenoid assembly; moving a pinion rotatably coupled to the motor toward an engaging position in which the engine may be cranked using the starter system and the solenoid switch is only capable of being in the closed state; monitoring a sensed voltage with the controller; and using the controller to determine, in the absence of the controller receiving a signal indicative of an engine speed, whether the engine is running on the basis of the monitored sensed voltage relative to a predetermined threshold voltage level.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A system for starting an engine, comprising:

a relay switch that is closed during a starting operation;

a starter assembly comprising:

a solenoid assembly including a solenoid switch adapted for connection to an electrical power source, a motor connected to the solenoid switch and energized by the electrical power source when the solenoid switch is closed, and a pinion rotatably coupled to the motor and moveable between an engaged position in which the engine may be cranked by the starter assembly and a disengaged position; and a controller connected to the relay switch;

wherein during a starting operation, if sensed motor energization voltage monitored by the controller falls below a predetermined threshold level within a predetermined time period after the application of electrical power to the solenoid assembly, the controller opens and recloses the relay switch to switch electrical power to the solenoid assembly off and on, whereby a "click-no-crank" event can be corrected during the starting operation.

2. The system of claim 1, wherein the controller is configured to switch electrical power to the solenoid assembly off and on by opening the relay switch, and waiting a predetermined time delay period before reclosing the relay switch, and optionally wherein the pinion does not enter a fully disengaged position prior to the controller reclosing the relay switch.

3. The system of claim 2, wherein the predetermined time delay period is a value less than 600 ms.

4. The system of claim 3, wherein the predetermined time delay period is a value less than 100 ms.

5. The system of claim 1, wherein the system is defined as a 24V starter system and the predetermined threshold level is a value less than 11.0V.

6. The system of claim 1, wherein the predetermined time period is a value no more than 150 ms.

7. The system of claim 1, wherein the relay switch is biased open and electromagnetically closed, and the system further comprises an activation coil to which voltage is applied during each starting operation, and wherein during a starting operation the controller is configured to selectively permit grounding of current through the activation coil to close the relay switch and prevent grounding of current through the activation coil to open the relay switch, and the controller is configured to regulate the relay switch through the selective grounding of the activation coil.

8. The system of claim 7, wherein the pinion is biased into its disengaged position in the absence of electrical power application to the solenoid assembly, and wherein the controller monitors sensed voltage applied to the activation coil and during a starting operation opens the relay switch when the sensed voltage applied to the activation coil rises to a threshold voltage level, whereby the pinion is automatically moved to the disengaged position upon the engine starting.

9. The system of claim 7, further comprising a momentary starter switch biased open and closed through operator actuation to commence each starting operation, wherein voltage is applied to the activation coil only when the momentary starter switch is closed.

10. The system of claim 1, wherein the system is for installation in a vehicle including the engine and a battery comprising the electrical power source, and wherein the system is operable independently of other vehicle control systems and without the controller monitoring a signal indicative of an engine speed, whereby the system defines a stand-alone starter system adapted for installation in a vehicle separately from other vehicle control systems.

11. The system of claim 1, wherein the controller monitors time elapsed after commencement of a starting operation and delays permitting reclosing the relay switch, whereby rapid re-engagement of the pinion and the engine is prevented.

12. The system of claim 1, wherein the electrical power source is a battery, and wherein the controller monitors sensed battery voltage and prevents the relay switch closing if the sensed battery voltage is greater than a predetermined threshold voltage, whereby starter assembly operation is prevented while the engine is running.

13. The system of claim 1, wherein the electrical power source is a battery, and wherein the controller monitors sensed battery voltage with the solenoid switch open and prevents the relay switch closing if the sensed battery voltage is no greater than a predetermined threshold voltage, whereby starter assembly operation is prevented if the sensed battery voltage is below the threshold voltage.

14. The system of claim 1, wherein the electrical power source is a battery, and wherein the controller monitors sensed battery voltage with the solenoid switch closed and opens the relay switch if the sensed battery voltage drops below a threshold voltage while the motor is energized, whereby the present starting attempt is aborted if battery voltage becomes lower than the threshold voltage during engine cranking.

15. The system of claim 1, wherein the controller monitors time elapsed after commencement of a starting operation, limits the maximum duration of an application of electrical power to the solenoid assembly to a first predetermined time period, and delays occurrences of consecutive starting operations by a second predetermined time period, whereby continuous cranking time and the frequency of starting operations are limited.

16. A unitary starter assembly comprising:

a relay switch that is closed during a starting operation;

a solenoid assembly including a solenoid switch adapted for connection to an electrical power source;

a motor connected to the solenoid switch and energized by the electrical power source when the solenoid switch is closed;

a pinion rotatably coupled to the motor and moveable between an engaged position in which the engine may be cranked by the starter assembly and a disengaged position; and a controller connected to the relay switch;

wherein during a starting operation, if sensed motor energization voltage monitored by the controller falls below a predetermined threshold level within a predetermined time period after the application of electrical power to the solenoid assembly, the controller opens and recloses the relay switch to switch electrical power to the solenoid assembly off and on, whereby a "click-no-crank" event can be corrected during the starting operation.

17. The starter assembly of claim 16, wherein the controller is configured to limit the number of times the relay switch is opened and reclosed to switch electrical power to the solenoid assembly off and on during the starting operation.

18. The starter assembly of claim 16, wherein the controller includes a plurality of functional circuits selectively interconnected in accordance with a starter system paradigm for regulating the relay switch, and the functional circuits include a gate drive circuit, a power driver circuit, a level circuit, a regulating circuit and a plurality of voltage divider circuits.

19. The starter assembly of claim 16, wherein the relay switch is biased open and electromagnetically closed, and the starter assembly further comprises an activation coil to which voltage is applied during each starting operation, and wherein during a starting operation the controller selectively permits grounding of current through the activation coil to close the relay switch and prevents grounding of current through the activation coil to open the relay switch, and the controller regulates the relay switch through the selective grounding of the activation coil.

20. A method for regulating a starter system, comprising:

providing electrical power to a relay switch;

commencing a starting operation with an operator-actuable starter switch;

using a controller during the starting operation to close the relay switch for applying electrical power to a solenoid assembly;

using the powered solenoid assembly to urge a pinion rotatable by an energized motor toward an engaged position in which the engine may be cranked using the starter system, and to connect the motor to an energizing electrical power source through a solenoid switch closed when the pinion is in the engaged position; and using the controller to monitor sensed motor energization voltage and for opening and reclosing the relay switch during the starting operation to switch electrical power to the solenoid assembly off and on if sensed motor energization voltage falls below a predetermined threshold level within a predetermined time period after the application of electrical power to the solenoid assembly, whereby a "click-no-crank" event can be corrected during the starting operation.

* * * * *